US007046583B2

(12) United States Patent
Andreis et al.

(10) Patent No.: US 7,046,583 B2
(45) Date of Patent: May 16, 2006

(54) HIGH-POWER TRANSMISSION ACOUSTIC ANTENNA

(75) Inventors: Daniel Andreis, Mandelieu la Napoule (FR); Sylvie Ponthus, Valbonne (FR)

(73) Assignee: Thales, Neuilly sur Seine (FR)

( * ) Notice: Subject to any disclaimer, the term of this patent is extended or adjusted under 35 U.S.C. 154(b) by 61 days.

(21) Appl. No.: 10/497,659

(22) PCT Filed: Dec. 6, 2002

(86) PCT No.: PCT/FR02/04219

§ 371 (c)(1),
(2), (4) Date: Jun. 4, 2004

(87) PCT Pub. No.: WO03/047770

PCT Pub. Date: Jun. 12, 2003

(65) Prior Publication Data

US 2005/0047278 A1 Mar. 3, 2005

(30) Foreign Application Priority Data

Dec. 7, 2001 (FR) ..... 01 15864

(51) Int. Cl.
*B06B 1/06* (2006.01)

(52) U.S. Cl. ..... 367/162

(58) Field of Classification Search ..... 367/162
See application file for complete search history.

(56) References Cited

U.S. PATENT DOCUMENTS

| | | | | |
|---|---|---|---|---|
| 3,160,138 | A * | 12/1964 | Platzman | 116/137 R |
| 3,707,401 | A | 12/1972 | Niebylski et al. | 428/312.2 |
| 3,821,834 | A | 7/1974 | McElroy | 29/25.35 |
| 4,214,484 | A * | 7/1980 | Abts | 73/632 |
| 4,921,415 | A | 5/1990 | Glascock, II et al. | 425/135 |
| 4,977,655 | A * | 12/1990 | Martinelli | 29/25.35 |
| 5,499,219 | A * | 3/1996 | Brenner et al. | 367/151 |
| 5,902,430 | A * | 5/1999 | Carpenter et al. | 156/148 |
| 6,276,212 | B1 * | 8/2001 | Cooper et al. | 73/632 |
| 2001/0032382 | A1 | 10/2001 | Lorraine et al. | 144/89 |

FOREIGN PATENT DOCUMENTS

| | | |
|---|---|---|
| DE | 196 23 035 | 5/1997 |
| DE | 199 57 125 | 6/2001 |
| EP | 0 559 963 | 9/1993 |
| FR | 2 462 837 | 2/1981 |

* cited by examiner

*Primary Examiner*—Tho Phan
(74) *Attorney, Agent, or Firm*—Lowe Hauptman & Berner, LLP

(57) ABSTRACT

The present invention relates to high-frequency antennas with high transmission power. The invention consists in making the backing layer of such an antenna with a heat-conductive foam and enables the transmission power to be appreciably doubled.

13 Claims, 3 Drawing Sheets

HIGH-POWER TRANSMISSION ACOUSTIC ANTENNA

CROSS-REFERENCE TO RELATED APPLICATIONS

The present application is based on International Application No. PCT/FR02/04219, filed on Dec. 6, 2002, entitled: "ACOUSTIC ANTENNA WITH HIGH TRANSMISSION POWER", which in turn corresponds to French Application FR 01/5864 filed Dec. 7, 2001, and priority is hereby claimed under 35 U.S.C. Section 119 based on these applications. Each of these applications is hereby incorporated by reference in their entirety into this application.

BACKGROUND OF THE INVENTION

The present invention relates to acoustic antennas, namely devices used for the transmission, by electrical signals, of acoustic, sonic or ultrasonic waves in water. Such antennas are used especially in sonar. The invention can be used, in particular, to send high acoustic power, or even very high acoustic power, with such an antenna.

It is known, in the field of signal processing and especially in sonar, that the greater the duration T of the pulses sent, the greater will be the processing gain which is proportional to the product BT (B: frequency band), and hence the greater the increase in detection performance.

There are known high-frequency transducers, typically used for transmission frequencies of over 50 KHz, constituted by a stack of layers known as "front" layer(s) (thin matching layers and/or tight-sealing membrane), a layer of active material (electrical/acoustic transduction) and layer(s) known as backing layer(s).

The phenomena of heating in the layer of active material, due to dielectric and mechanical losses, restrict the transmission peak power when the duration of the pulse is increased. Thus, for a material consisting of piezoelectric ceramics, the typical functioning of a transducer roughly follows the profile shown in FIG. 1.

This limiting of the level of allowable power for the long pulses is related to the use of materials having low heat conductivity for the matching thin layers, the backing as well as the tight-sealing membrane. Indeed, in the prior art, these elements are made out of materials comprising an elastomer matrix (such as rubbers, polyurethanes and silicones) or resin, especially epoxide, giving rise to inefficient discharge of the heat generated by the transducer into the carrier structure or into seawater.

There are known heat-conductive materials that take the form of foams. Reference may be made especially to the metal foams made of aluminum, nickel, nickel-chrome, copper or steel, as well as to non-metal foams made of carbon or silicon carbide. These foams have heat conductivity about 20 times greater than that of the charged epoxy resin type of composite materials used as matching or backing materials in the high-frequency transducers corresponding to the prior art. It is 50 times greater than that of rubbers constituting the impervious membranes used in these transducers.

From the German patent 19 623 035 filed by the firm STN Atlas, there is a known low-frequency transducer whose horn and/or rear mass are constituted by an expanded metal whose density is adjusted to obtain a determined resonance frequency.

To this end, the horn and/or the rear mass are obtained by molding the basic metal with an appropriate dose of foaming agent. However, this method of manufacture is difficult to implement and control, and this is a serious drawback.

SUMMARY OF THE INVENTION

To overcome these drawbacks, the invention proposes a high-frequency acoustic antenna with high transmission power comprising a stack formed by at least one front protection layer, at least one layer of active material and at least one reflector-forming backing layer, chiefly characterized in that this backing layer is constituted by a heat-conductive foam.

According to another characteristic, the backing layer is bonded to one face of the layer of active material and is applied on the other face to a metal support in contact with the medium into which the antenna is plunged, and the layer of active material is formed by columns of piezoelectric ceramic.

According to another characteristic, the backing layer is formed by metal foam.

According to another characteristic, this metal foam is compressed.

According to another characteristic, a printed circuit for electric connection is inserted between the front layer and the layer of active material and a metal film is inserted between the active layer and the backing layer and forms the cold point According to another characteristic, it comprises a metal film inserted between the front layer and the layer of active material and forming the cold point, and a printed circuit and an insulating film inserted between the layer of active material and the backing layer.

According to another characteristic, the high-frequency acoustic antenna with high transmission power comprises a stack formed by at least one front protection layer, at least one layer of active material and at least one reflector-forming backing layer, the layer is constituted by a plate made of open-cell metal foam filled with a material achieving acoustic matching, the front layer is bonded to the layer of active material by means of metal film forming the cold point, and it comprises a printed circuit inserted between the layer of active material and the backing layer.

According to another characteristic, the backing layer is constituted by a heat-conductive foam.

According to another characteristic, the acoustic antenna constitutes the transmission antenna or the transmission/reception antenna of an underwater imaging sonar.

BRIEF DESCRIPTION OF THE DRAWINGS

Other features and advantages of the invention shall appear clearly in the following description, presented by way of a non-restrictive example with reference to the appended figures, of which.

DETAILED DESCRIPTION OF THE INVENTION

Figure 1:
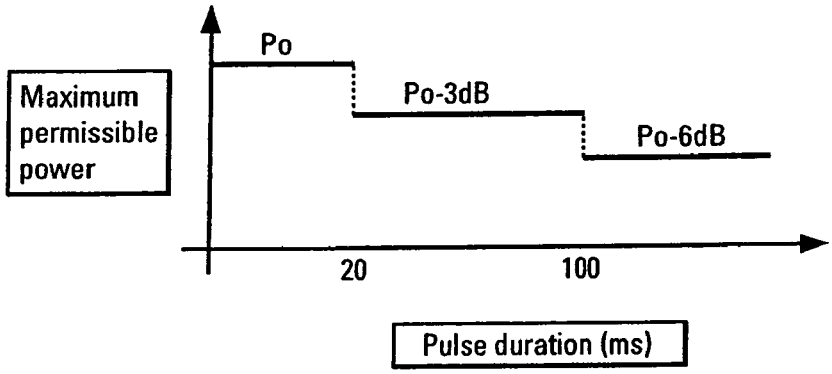
Fig. 1 PRIOR ART
FIG. 1 is the graph of the maximum power/pulse duration of a prior art transducer.
Figure 2:
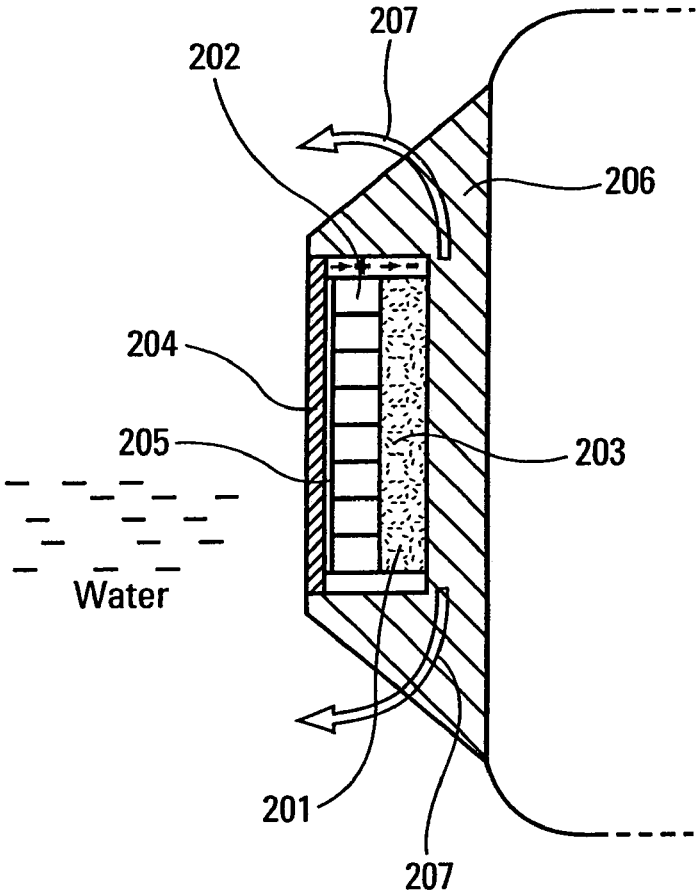
FIGS. 2 to 5 show views in section of transducers according to different embodiments of the invention.

FIG. 2 shows a view in a vertical plane section of a high-frequency transducer laid out to form a sonar antenna according to the invention. This antenna is formed by several columns of juxtaposed transducers (here they are piezoelectric ceramic cubes).

According to a preferred embodiment of the invention, the rear part forming the "backing" of each column is constituted by a plate made of metal foam.

Such a foam is commercially available in the form of plates. One example of an embodiment of the invention uses a product referenced DUOCEL 10 PPI, available from the firm ERG (USA). This open-cell foam is based on aluminum and possesses the following characteristics:

density: 0.21 g/cm$^3$ usual thickness of the plates: 13 mm diameter of the cells: ≅0.6 mm with a porosity of 10 PPI heat conductivity of the ligaments: 237 W/mK heat conductivity of the foam: 3.04 W/mK The selected plate is advantageously cold-compressed mechanically so as to obtain the desired density. This also increases its resistance to pressure. Thus, the backing 201 was obtained in one exemplary embodiment by reducing the thickness to 4 mm to obtain a density in the range of 0.7 g/cm$^3$.

In the preferred embodiment, the backing constitutes the electric cold point. It is made in one piece which, after being shaped to the right dimensions, is bonded to the columns of ceramic 202 by means of an epoxy bonder, via a metal film 203 forming the ground plane. The antenna proper is then completed by the front layer or layers 204 positioned on the ceramic columns through a printed circuit 205 provided with tracks which, according to a known technique, provide electrical power to each column of transducers.

As can be seen in FIG. 2, the unit is placed in a metal support 206. Thus the heat is discharged into the water through the backing which is put into direct contact with this support. Advantageously, a paste favoring the heat exchanges is inserted between the foam and the support. In FIG. 2, the heat flux is indicated by arrows 207.

Figure 3:
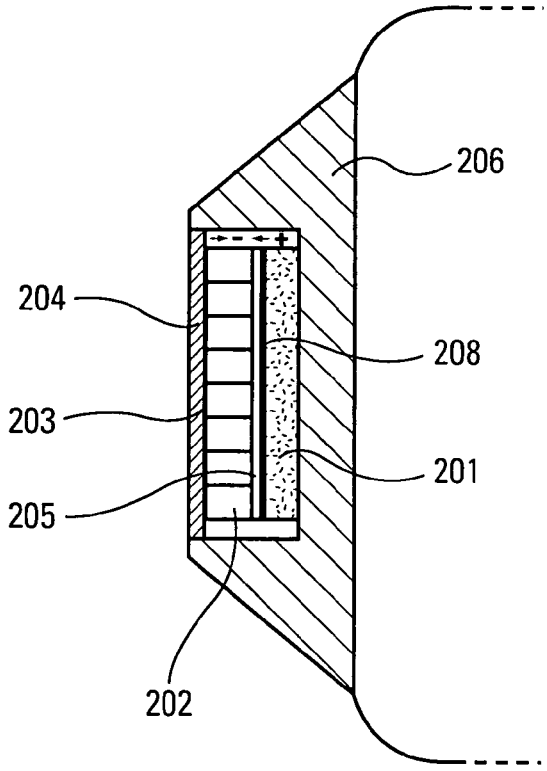

According to a second embodiment, shown in FIG. 3, the cold point is placed on the front layer(s) side, the hot point being located on the backing side. In this variant, the printed circuit 205 provided with tracks is inserted between the columns of ceramics 202 and the foam 201. Furthermore, an electrically insulating thin film 208 is placed between the printed circuit and the foam, the thickness and the material of this film being chosen so as to let the heat flux pass through. The metal film 203 forming the ground plane is inserted between the front layers 204 and the ceramic columns 203.

Figure 4:
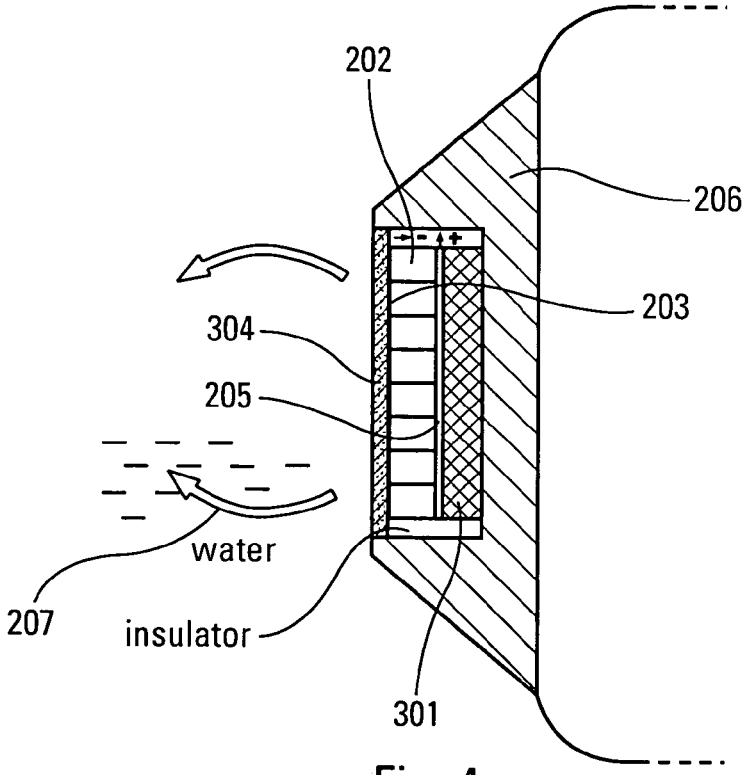

According to a third embodiment, shown in FIG. 4, only the front layer(s) are constituted by a foam 304 made of conductive material. This foam is advantageously an open-cell metal foam so as to be impregnated with the material generally used for the front layers, polyurethane or elastomer in the case of a membrane, charged or uncharged epoxy resin in the case of matching thin layers. The foam then serves as a metal skeleton enabling the thin-layers to be made heat-conductive.

The desired density is adjusted by means of the filler material and the foam therefore does not need to be compressed for this function. However, it may advantageously be compressed to increase the heat exchanges. Such charged foams are known inter alia from the U.S. Pat. No. 3,707,401 filed on 26 Dec. 1972.

In this embodiment, only one printed circuit 205 is inserted between the columns of ceramics and the backing 301, which is made in one piece out of a classic material that can be used to obtain impedance matching, for example a low-density alveolar material.

As in the second embodiment, a metal film 203 is inserted between the front layer(s) and the columns of ceramics.

Figure 5:
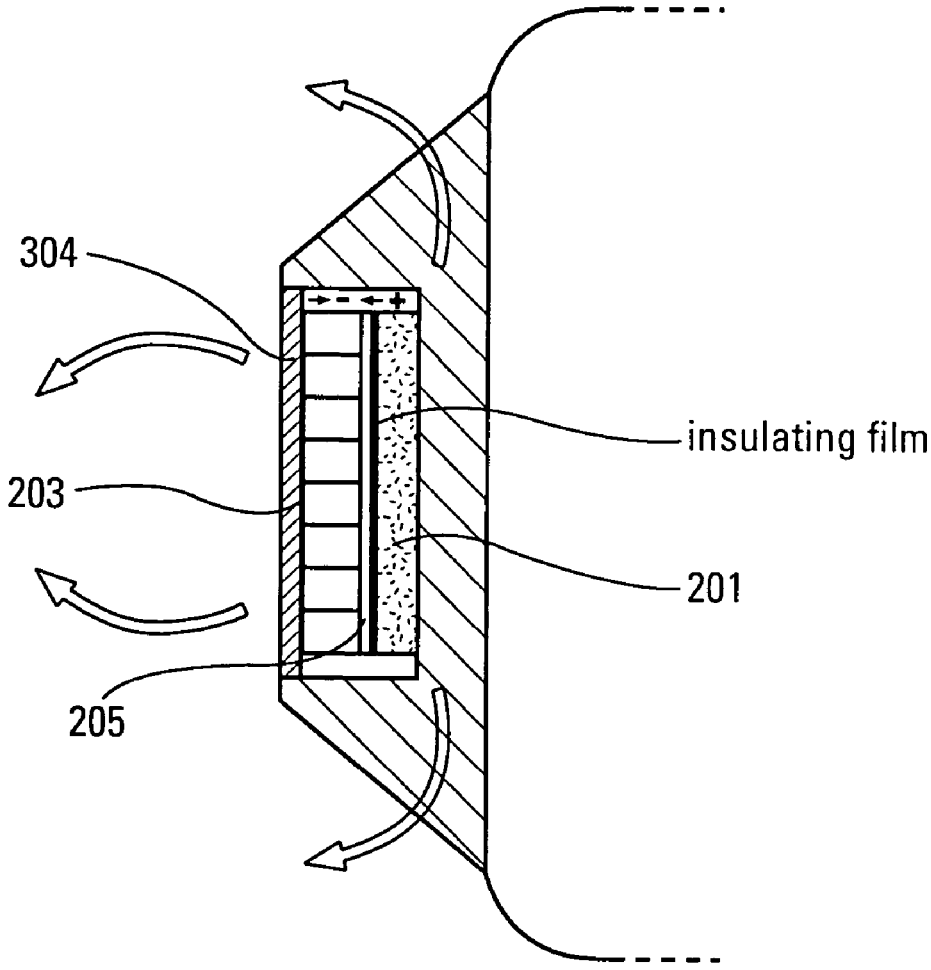

According to a fourth embodiment, shown in FIG. 5, the backing 201 and the front layer(s) 304 are made out of conductive material, preferably metal foam for the backing and filled metal foam for the front layers.

According to one variant, the metal films, inserted either between the backing and the columns of ceramics or between the front layers and the columns of ceramics, are eliminated in taking advantage of the conductive character of the metal foams.

In the preferred embodiment, the ceramic reaches a temperature of 65° C. for an electric power density of 110 W/cm$^2$, as against only 60 W/cm$^2$ at the same temperature for a backing made of a material that is not heat-conductive.

It is then possible with the invention, to obtain an increase by almost a factor of 2 in the duration of the pulse emitted at a constant power level close to the maximum allowable value.

Without departing from the framework of the invention, the embodiments corresponding to the FIGS. 4 and 5 may be the object of variants consisting in inverting the hot and cold points. In this case, a metal film separates the backing from the columns of transducers, and the front layer(s) are then electrically insulated between each column.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

The invention claimed is:

1. A high-frequency acoustic antenna with high transmission power, comprising:

a stack formed by at least one front protection layer, at least one layer of active material and at least one reflector-forming a backing layer, said backing layer being constituted by a heat-conductive metal foam, the acoustic impedance of said metal foam being adapted by preliminary compression, said backing layer being positioned between said layer of active material and a metal support in contact with the medium into which the antenna is plunged in order to achieve thermal continuity.

2. The antenna according to claim 1, wherein said layer of active material is formed by columns of piezoelectric ceramic.

3. The antenna according to claim 2, comprising a printed circuit for electric connection and a metal film, said printed circuit being inserted between said front layer and said layer of active material, said metal film being inserted between said layer of active material and said backing layer and forming a cold point.

4. An underwater imaging sonar comprising an acoustic antenna according to claim 3.

5. The antenna according to claim 3, comprising a metal film and a printed circuit for electric connection, said metal film being inserted between said front layer and said layer of active material and forming a cold point, said printed circuit being inserted between said layer of active material and said backing layer.

6. The antenna according to claim 2, comprising a metal film and a printed circuit for electric connection, said metal film being inserted between said front layer and said layer of active material and forming a cold point, said printed circuit being inserted between said layer of active material and said backing layer.

7. An underwater imaging sonar comprising an acoustic antenna according to claim 6.

8. The antenna according to claim 2, comprising a metal film and a printed circuit for electric connection, said metal film being inserted between said front layer and said layer of active material and forming a cold point, said printed circuit being inserted between said layer of active material and said backing layer.

9. The antenna according to claim 1, comprising a printed circuit for electric connection and a metal film, said printed circuit being inserted between said front layer and said layer of active material, said metal film being inserted between said layer of active material and said backing layer and forming a cold point.

10. A high-frequency acoustic antenna with high transmission power, said antenna comprising a stack formed by at least one front protection layer, at least one layer of active material and at least one reflector-forming a backing layer, said front protection layer being constituted by a plate made of open-cell metal foam filled with a material achieving acoustic matching, said front layer being bonded to said layer of active material by means of a metal film forming a cold point, said antenna comprising a printed circuit inserted between said layer of active material and said backing layer.

11. The antenna according to claim 10, wherein said backing layer is formed by a thermally conductive metal foam.

12. The antenna according to claim 11, wherein said metal film is compressed beforehand.

13. An underwater imaging sonar comprising an acoustic antenna according to claim 11.

* * * * *